US006217507B1

(12) United States Patent
Bonvik

(10) Patent No.: US 6,217,507 B1
(45) Date of Patent: Apr. 17, 2001

(54) ISOLATION UNIT

(76) Inventor: Knut Bonvik, 7310, Gjölme (NO)

( * ) Notice: Subject to any disclaimer, the term of this patent is extended or adjusted under 35 U.S.C. 154(b) by 0 days.

(21) Appl. No.: 09/180,946

(22) PCT Filed: Apr. 25, 1997

(86) PCT No.: PCT/NO97/00110

§ 371 Date: Jun. 3, 1999

§ 102(e) Date: Jun. 3, 1999

(87) PCT Pub. No.: WO97/43995

PCT Pub. Date: Nov. 27, 1997

(51) Int. Cl.[7] ..... A61G 10/00
(52) U.S. Cl. ..... 600/21
(58) Field of Search ..... 600/21–22; 312/1, 312/3; 5/97; 128/202.12, 205.26; 454/187

(56) References Cited

U.S. PATENT DOCUMENTS 3,774,522 * 11/1973 Marsh ..... 600/21 X
3,818,896 * 6/1974 Deaton ..... 600/22
3,875,927 * 4/1975 Trexler ..... 600/21
4,736,762 * 4/1988 Wayman ..... 128/205.26
5,832,919 * 11/1998 Kano et al. ..... 128/205.26 X

* cited by examiner

*Primary Examiner*—Samuel G. Gilbert
*Assistant Examiner*—Joseph A. Cadugan
(74) *Attorney, Agent, or Firm*—James E. Bradley; Bracewell & Patterson

(57) ABSTRACT

An isolation unit for use with somatic healthcare has a framework of inflatable channels spaced apart, making the isolation unit self-supporting. Windows are located between the channels for allowing access to the interior of the isolation unit. At least one tube is situated in the isolation unit for circulating gas mixtures from the control unit. The isolation unit has a molecule structure allowing the tube to be connected to the corresponding tube of another module.

20 Claims, 3 Drawing Sheets

ISOLATION UNIT

The invention concerns an isolation unit for use somatic health care, according to the introductory part of Patent claim 1.

BACKGROUND

Controlling infections at hospitals and health care institutions is an increasing problem. This has created a need for simple systems that isolate and protect both patient and staff. In addition, patients often have reduced body functions and require special environmental conditions such as controlled air temperature, air moisture and oxygen supply.

From U.S. Pat. No. 2,915,074 a device is known for patient treatment comprising a rectangular horizontal bottom piece having semi-rigid side walls. The side walls have inflatable air channels for support. This known device is primarily intended as an alternative to different masks, that is, to cover the head. The possibility of covering the whole body, or to be able to open certain parts for operations, etc. is not disclosed.

Furthermore, U.S. Pat. No. 2,915,074 describes the use of a plastic material that has a stiffness which implies that the device has a supporting ability per se. The described air channels comprise only a part of the supporting construction, and are integrated with the side walls. Thus the construction is only collapsible and not totally flexible, and it is not possible to use different materials for covering of walls.

SUMMARY OF THE INVENTION

It is thus an object of present invention to provide an inflatable isolation unit that can protect patient and staff in respect of danger of infection, and establish a controllable inner environment in respect of oxygen, temperature, etc. The isolation unit of this invention has upper and lower inflatable longitudinal channels that are connected to inflatable upper and lower cross channels by upright channels. When inflated, this defines a generally rectangular self supporting framework having two sides, a top and two ends. The channels defining the tops the sides, the top and the ends are separated from each other, providing windows at the sides, the top and the ends. The windows are open for access to the interior of the isolation unit. The windows can be closed with a cover to isolate atmosphere in the isolation unit. At least one perforated tube is disposed within the isolation tube. A fan communicates with the perforated tube for circulating the gas through perforations.

BRIEF DESCRIPTION OF THE DRAWINGS

In the following, the invention will be explained further by way of examples of embodiments and with reference to the accompanying drawings, where.

Figure 1:
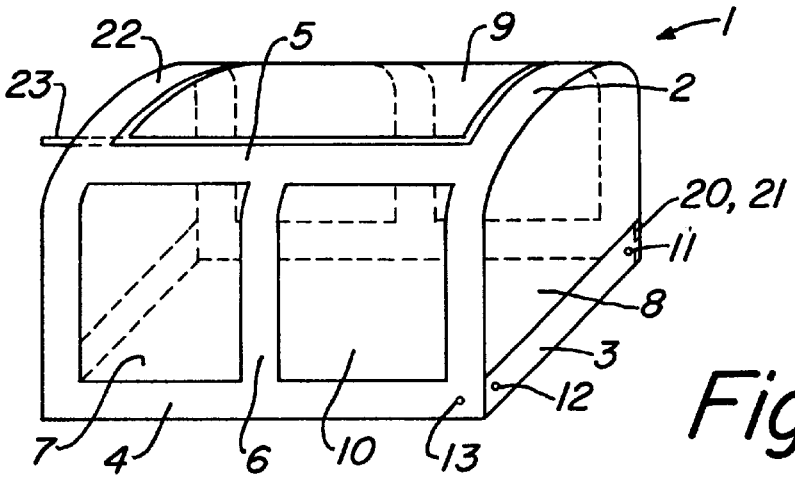
FIG. 1 shows a first example of an embodiment of an isolation unit according to the present invention when inflated.

An isolation unit 1 illustrated in FIG 1. The isolation unit 1 comprises a framework of inflatable channels 2–6, a bottom 7 and windows 8–10. Preferably, isolation unit 1 is made in a plastic material. The bottom 7 is also inflatable, and constitutes a mattress for the isolation unit 1. Perforated tubes 11 and 12 are situated in the bottom 7, in order to provide controlled entry of air or another gas mixture of a desired quality into isolation unit 1.

The inflation of isolation unit 1 is performed through a nipple 13 located at bottom 7. All of the channels 2–6 and the bottom 7 are connected to each other, so that the whole isolation unit 1 can be inflated by provision of air through the nipple 13.

Figure 2:
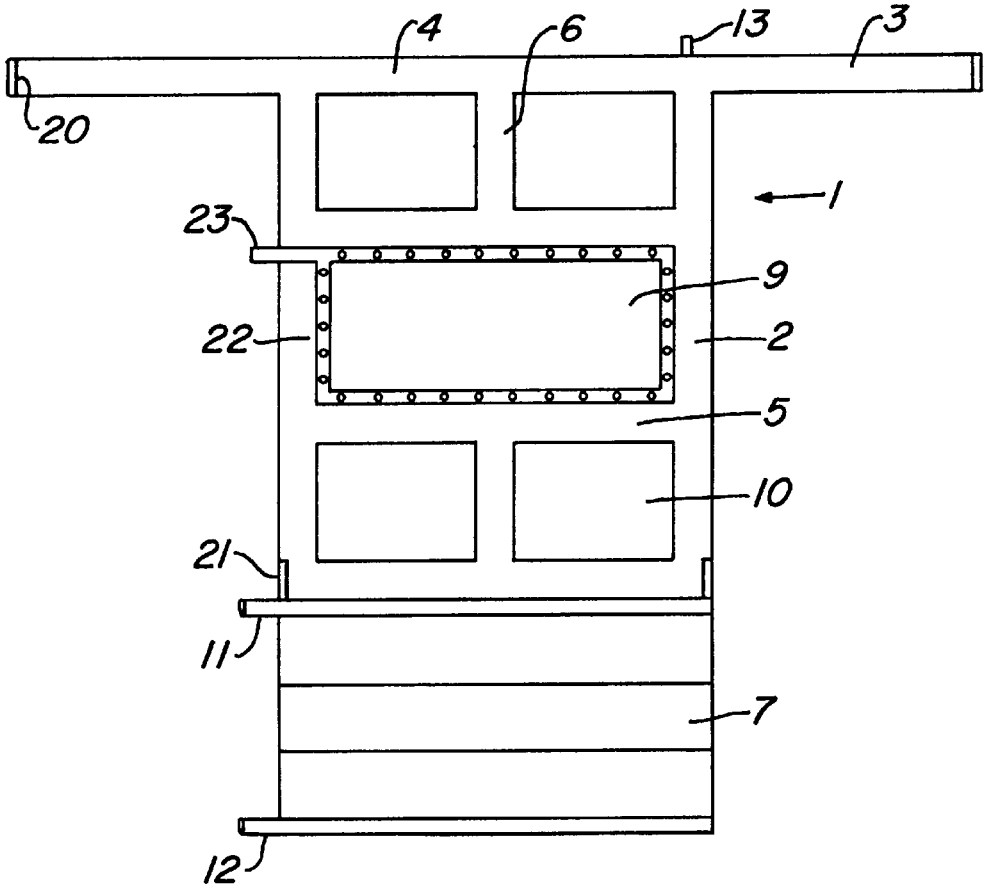
FIG. 2 shows the isolation unit from FIG. 1 when deflated.

The construction detail of the isolation unit is best illustrated in FIG. 2. A channel 2 is situated at each of the short sides or ends of the isolation unit 1, over a lower cross channel 3. Each channel 2 has an lower portion and two upright or vertical portions. A lower longitudinal channel 4 is connected to the channels 2 and 3. Furthermore, an upper longitudinal channel 5 connects with the two opposing channels 2. Between upper longitudinal channel 5 and lower longitudinal channel 4 are situated middle channels 6. All support channels 2–6 are interconnected, so they all may be filled with air from one site, i.e. nipple 13.

Each of the lower cross channels 3 has a free end, provided with a texture tape or a VELCRO fasteners 20. These are provided to fasten to corresponding VELCRO fastener 21 one of the lower longitudinal channels for connecting the bottom channels in the isolation unit. This connection can also be performed in other known ways, for example by hooks or push buttons.

In the areas delimited by the channels 2–6 are provided recesses or windows 8–10. Delimited by the channel 2 and lower cross channel 3 is a short side or end window 8. Between two opposite channels 2 and opposite upper longitudinal channels is situated a top window 9. Furthermore, a total of four side windows 10 are delimited by the upper longitudinal channel 5, lower longitudinal channels 4, middle channels 6 and the channels 2.

Around the window 9, there is preferably a perforated channel 22 is situated, communicating with a nipple 23. Through this nipple 23, filtered air may be provided, or air may be sucked out, forming an overpressure or underpressure. The purpose therefore is to produce a controlled air flow so that dust particles and similar potential infection carriers are kept away from the operation area.

The channels 2–6 are the carrying elements of the isolation unit 1. In inflated condition they will make the construction self-supporting, and not dependent upon an inner overpressure in order to maintain its desired shape.

In order to establish a closed, delimited room a flexible, transparent cover (not shown)is located over the supporting channels 2–6. This forms walls and a roof for isolation unit 1, and may have a plurality of embodiments. Firstly, the channels 2–6 may be an integrated part of a plastic cover, having single or double walls. Double walls give large power savings when heating is necessary.

Furthermore it is possible to let the windows be covered by one or more separate free films of different shape, which are placed over the channels 2–6. For example, these can be in the form of disposable "plastic sheets" which are fixed to the supporting structure by texture tape.

Both with separate covers and in the cases where the channels 2–6 are an integrated part of the cover, different methods may be used. For example, a cover with cuffs having a rubber band in their ends may be used, making it possible for the staff to place their hands into the isolation unit without destroying the isolation. In some embodiments, such as incubators for small children, it may be necessary to open all or part of the side wall. It may be locked by use of a VELCRO fastener. When used during a surgical operation, all or part of the top window 9 may be opened in order to readily access the patient.

Figure 3:
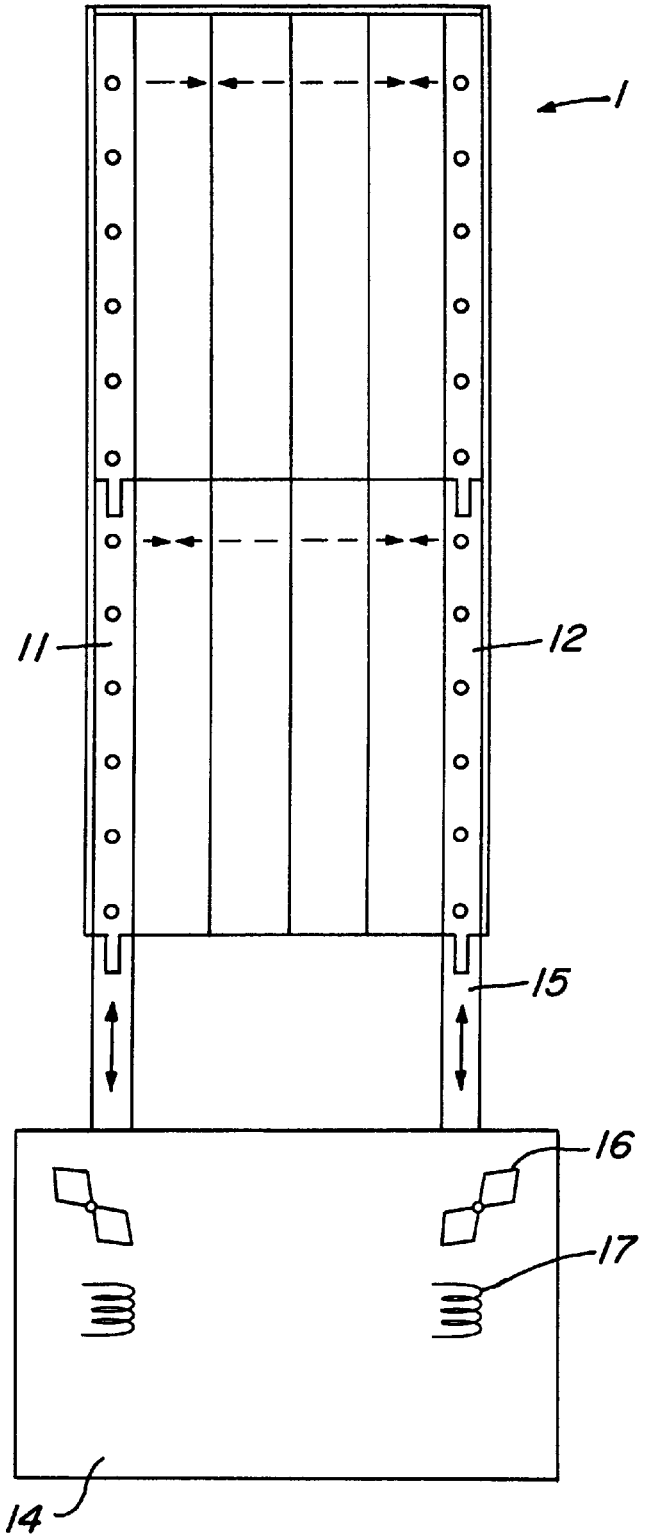
FIG. 3 shows a connection of two modules of the isolation unit from FIG. 1 together with accompanying equipment.

The tubes 11, 12 are fed from the outside through a controller 14, which is illustrated in FIG. 3. The controller 14 is equipped with two tubes 15, providing a supply of air or another gas having a given quality through the perforated tubes 11, 12 which are situated in the bottom of the isolation unit 1. Furthermore, the controller 14 is equipped with fans 16 and a heating element 17. The air flow can be programmed so that in-going air is on one side, and out-going air is on the other side. This provides a good air circulation in cases where. for example, heating is the primary issue. Alternatively, both sides may be run with in-going air so that a controlled filtration air flow is achieved, flowing from a possible operation area or similar, where unwanted particles can cause infections. By running in-going air and out-going air with different velocity, an over- or under-pressure can be generated in the isolation unit 1.

Furthermore, in-going air may be run from both sides. This can be favorable during operations, as a filtered air flow, flowing from the operation site is achieved, and prevents particles from the air from reaching the wound. In this kind of use, one is dependent upon the windows not being covered.

Lower channels 3, 4, are an integrated part of a mattress, 7. A mattress having two or more channels constitutes a unit or a module. More modules can be connected to an isolation unit having varying size. FIG. 3 illustrates an isolation unit comprising two modules. The heating tubes 11, 12 from one of the modules are connected to the heating tubes 11, 12 in the next module, so that air is distributed in all of the isolation unit 1.

Figure 4:
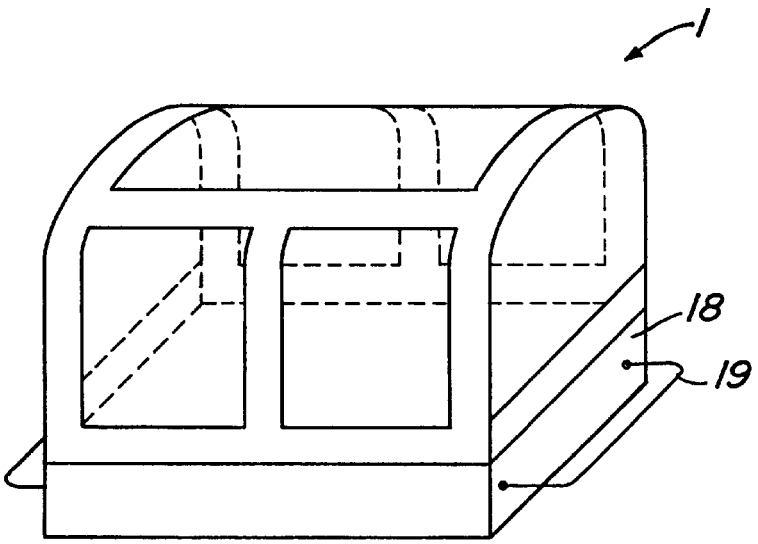
FIG. 4 shows a second example of an embodiment of an incubator according to the present invention when inflated.
Figure 5:
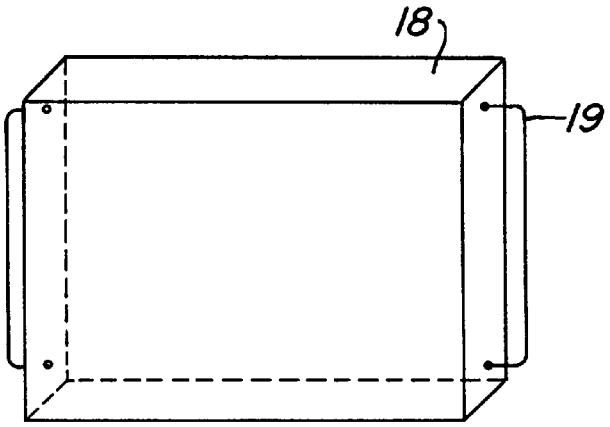
FIG. 5 shows the incubator from FIG. 4 when folded up.

FIGS. 4 and 5 show the isolation unit 1 used as an incubator for a newborn, in assembled and folded condition, respectively. The flexible inflatable top has been described above, where the channels 2–6 are integrated in a transparent, two-layer plastic. The top is connected to a bottom frame 18 that is equipped with a carrying handle 19. The bottom frame 18 is preferably made of metal, and has integrated control electronics and oxygen supply, etc.

The incubator will, in its folded condition, not be much more space consuming than the bottom frame, and will be excellent as a transportable incubator. It requires a minimum of space for storage purposes and can, for example, be stored in most ambulances, medical offices and similar. Furthermore, it is light and easy to assemble, the weight down to 1/10 of previously known transporable incubators. A good thermal insulation gives a low power consummation, which means smaller batteries and longer life. An incubator according to present invention is also inexpensive.

The present invention provides a simple and very flexible inflatable isolation unit which can be used during operations for bacterial protection, and afterwards follow the patient to recovery ward and sleeping ward. In addition to protecting the patient, it is also possible to isolate any danger of infection and undesired spreading of bacteria.

Besides bacterial protection, the isolation unit could also provide the patient with a controllable environment, and can for example replace the great number of systems with heating mattresses which are in use today. The isolation unit is produced in a plastic material and through modularity and flexibility there will be a number of applications possible.

What is claimed is:

1. An isolation unit comprising:

inflatable upper and lower longitudinal channels connected to inflatable upper and lower cross channels by inflatable upright channels, defining a generally rectangular self-supporting framework, having two sides, a top, and two ends when inflated;

wherein the channels are separated from each other by voids, forming windows at the sides, the top and the ends for access into the isolation unit;

at least one tube disposed within the isolation unit for communicating and circulating a gas into the isolation unit;

at least one sheet of film for selectively covering the windows; and wherein the windows form an insolated atmosphere in the isolation unit.

2. The isolation unit according to claim 1, wherein the tube extends along at least one of the channels and has a plurality of perforations for communicating with the gas within the isolation unit.

3. The isolation unit according to claim 1, wherein the tube extends along at least one of the channels, is perforated, has one end adapted to be connected to a source of gas and another end adapted to be connected to a perforated tube in an adjacent one of the isolation units, for communicating gas to said perforated tube in said adjacent one of the isolation units.

4. The isolation unit according to claim 1, wherein said at least one tube extends along at least one of the lower longitudinal channels and has a plurality of perforations.

5. The isolation unit according to claim 1, wherein said at least one tube extends around a perimeter of the top window.

6. The isolation unit according to claim 1, wherein said at least one tube comprises:

a pair of perforated tubes, each extending along one of the lower longitudinal channels; and a perforated tube extending around a perimeter of the top window.

7. The isolation unit according to claim 1, further comprising an inflatable bottom joined to the lower longitudinal channels and lower cross channels.

8. The isolation unit according to claim 1, wherein each of the lower cross channels has a free end that is releasably securable to one of the lower longitudinal channels, to enable the framework to lie in a flat configuration when deflated.

9. An isolation unit comprising:

inflatable upper and lower longitudinal channels connected to inflatable upper and lower cross channels inflatable by upright channels, defining a generally rectangular self-supporting framework, having two sides, a top, and two ends when inflated;

the channels being separated from each other, forming windows at the sides, the top and the ends, that are adapted to be opened for access to an interior of the isolation unit and selectively covered to isolate an atmosphere in the isolation unit;

an inflatable bottom extending between the lower longitudinal channels and lower cross channels;

at least one perforated tube disposed within the isolation unit and extending along at least one of the channels; and a fan in fluid communication with the perforated tube for circulating a gas through perforations of the perforated tube.

10. The isolation unit according to claim 9, wherein the tube has one end adapted to be connected to another perforated tube in an adjacent one of the isolation units, for communicating gas to said another perforated tube and said adjacent one of the isolation units.

11. The isolation unit according to claim 9, wherein said at least one perforated tube comprises a pair of perforated tubes, each extending along one of the lower longitudinal channels.

12. The isolation unit according to claim 9, wherein said at least one perforated tube extends along the upper longitudinal channels and upper cross channels.

13. The isolation unit according to claim 9, wherein said at least one perforated tube comprises:

a pair of perforated tubes, each extending along said one of the lower longitudinal channels; and a perforated tube extending along the upper longitudinal channels and the upper cross channels.

14. The isolation unit according to claim 13 wherein each of the lower cross channels has a free end that is releasably securable to one of the lower longitudinal channels, to enable the framework to lie in a flat configuration when deflated.

15. A method of creating an isolated atmospheric environment, comprising:

(a) providing an isolation unit having inflatable upper and lower longitudinal channels connected to inflatable upper and lower cross channels inflatable by upright channels, and inflating the channels to define a generally rectangular self-supporting framework, having two sides, a top, and two ends, with the channels being separated from each other, forming and windows at the sides, the top and the ends;

(b) placing at least a portion of a patient's body within the isolation unit;

(c) closing at least some of the open windows to enclose at least a portion of the patient's body within the isolation unit; and (d) delivering a gas into the isolation unit to provide a desired atmosphere within the isolation unit.

16. The method according to claim 15, wherein step (b) comprises inserting at least a portion of the patient's body through one of the windows on the sides or the ends.

17. The method according to claim 15, wherein in step (b) only a portion of the patient's body locates within the isolation unit.

18. The method according to claim 15, wherein in step (b) at least a portion is inserted through one of the windows on the sides and the ends, and a remaining portion is outside of the isolation unit.

19. The method according to claim 15, further comprising:

providing another isolation unit in accordance with step (a);

abutting said another isolation unit with said first-mentioned unit; and inserting another portion of the patient's body in said another isolation unit.

20. The method according to claim 15, wherein step (d) comprises flowing the gas through a perforated tube located within the isolation unit, and wherein the method further comprises:

providing another isolation unit in accordance with wherein step (a);

abutting said another isolation unit with said first-mentioned isolation unit;

providing said another isolation unit with a perforated tube and connecting said perforated tube to the perforated tube of said first-mentioned isolation unit, and flowing gas first through the perforated tube of said first-mentioned isolation unit, then into the perforated tube of said another unit.

* * * * *